US007498529B2

(12) United States Patent
Peng

(10) Patent No.: US 7,498,529 B2
(45) Date of Patent: Mar. 3, 2009

(54) NETWORK JACK AND MANUFACTURING METHOD THEREFOR

(76) Inventor: John Peng, 4 Fl., No. 12, Lane 270, Sec. 3, Peishen Rd., Shenkeng Township, Taipei County 222 (TW)

( * ) Notice: Subject to any disclaimer, the term of this patent is extended or adjusted under 35 U.S.C. 154(b) by 0 days.

(21) Appl. No.: 11/724,356

(22) Filed: Mar. 14, 2007

(65) Prior Publication Data

US 2008/0017485 A1 Jan. 24, 2008

(30) Foreign Application Priority Data

May 19, 2006 (TW) ..... 95117989 A
Nov. 7, 2006 (TW) ..... 95141223 A

(51) Int. Cl.
*H01R 33/96* (2006.01)

(52) U.S. Cl. ..... 200/51.09; 29/844; 439/676

(58) Field of Classification Search ..... 439/676; 200/51.09; 29/844, 842, 874, 876, 884, 882
See application file for complete search history.

(56) References Cited

U.S. PATENT DOCUMENTS

| | | | | |
|---|---|---|---|---|
| 5,178,563 | A * | 1/1993 | Reed | 439/676 |
| 5,766,043 | A * | 6/1998 | Talend | 439/676 |
| 5,803,770 | A * | 9/1998 | Swendson et al. | 439/676 |
| 6,116,943 | A * | 9/2000 | Ferrill et al. | 439/676 |
| 6,749,466 | B1 | 6/2004 | Milner et al. | 439/676 |
| 7,024,763 | B2 * | 4/2006 | Mathieu et al. | 29/837 |

* cited by examiner

*Primary Examiner*—Edwin A. Leon
(74) *Attorney, Agent, or Firm*—Haverstock & Owens LLP

(57) ABSTRACT

A network jack is provided. The network jack includes a circuit board, first contacts, second contacts and an acting portion. The circuit board has a first side, plural first contacting areas arranged along the first side and plural second contacting areas. The plural first contacting areas are between the plural second contacting areas and the first side, and plural distances between the first side and each of the plural second contacting areas are various. The first contacts are mounted on the first contacting areas and the second contacts are mounted on the second contacting areas. The acting portion bends the second contacts.

17 Claims, 22 Drawing Sheets

NETWORK JACK AND MANUFACTURING METHOD THEREFOR

FIELD OF THE INVENTION

The present invention relates to the network jack and the manufacturing method therefor, and more particular to the network jack having two parallel contact pairs and the manufacturing method therefor.

BACKGROUND OF THE INVENTION

In general, a network jack is applied to connect the computer to the internet. The conventional network jack has eight wire pins to electrically connect with the eight wires of a jumper.

Please refer to FIG. 1, which shows a diagram of the circuit board disclosed in FIG. 13 of U.S. Pat. No. 6,749,466 B1. As shown in FIG. 1, the circuit board 10 has four pairs of contacts 13, 14, 15, and 16 mounted thereon. The pair of contact 13 has a first contact 131 and a second contact 132, the pair of contact 14 has a third contact 141 and a fourth contact 142, the pair of contact 15 has a fifth contact 151 and a sixth contact 152, and the pair of contact 16 has a seventh contact 161 and an eighth contact 162. The first contact 131, the second contact 132, the third contact 141, the fourth contact 142, the fifth contact 151 and the sixth contact 152 are arranged on the first, second third, fourth, fifth and sixth positions 1311, 1321, 1411, 1421, 1511 and 1521, which are on the same line L1 along the short-side 102 and perpendicular to the long-side 101, and the seventh contact 161 and the eighth contact 162 are arranged on the seventh and eighth positions 1616 and 1621, which are arranged on another line L2. It is to be noted that in order to simplify the similar illustrations for contacts 131, 132, 141, 142, 151, 152, 161 and 162, only the illustration for the seventh contact 161 is described hereinafter. The seventh contact 161 has a fasten end 1611 and a free end 1612.

The network jack disclosed in U.S. Pat. No. 6,749,466 and other network jacks have some disadvantages. For example, the distance between the two contacts of the same pair of contacts is too small, so that the network jack could not afford the operating voltage higher than 800 volts. In addition, it is necessary to provide a push foot 1613 on the fasten end 1611 of the seventh contact 161 to mount the seventh contact 161. Furthermore, the contacts in U.S. Pat. No. 6,749,446 are rectangular so that their flexibilities are not so good. Moreover, the conventional contacts are made of beryllium copper, which is a high-cost material. Additionally, the conventional contacts are formed by a punch and then mounted into the circuit board. Taking the seventh contact 161 as an example, after the seventh contact 161 is mounted onto the circuit board 10 with the push foot 1613, the seventh contact 161 would be bent by a machine so as to form the three bending portions 1614, 1615 and 1616. As above, the conventional manufacturing process of the network jack is complex. In addition, the contacts of some conventional network jacks are arranged randomly, such as the contacts shown in FIG. 16 of U.S. Pat. No. 6,749,446, so that it is difficult to assemble the relevant network jacks.

As mentioned above, a network jack and the relevant manufacturing method are thus highly desired if they are able to overcome the drawbacks of the conventional network jack, such as the narrow operating voltage range, the high cost, the complex manufacturing process and the delicate assembling required.

SUMMARY OF THE INVENTION

In accordance with an aspect of the present invention, a network jack is provided. The network jack includes a circuit board, first contacts, second contacts and an acting portion. The circuit board has a first side, plural first contacting areas arranged along the first side and plural second contacting areas. The plural first contacting areas are between the plural second contacting areas and the first side, and plural distances between the first side and each of the plural second contacting areas are various. The first contacts are mounted on the first contacting areas and the second contacts are mounted on the second contacting areas. The acting portion bends the second contacts.

Preferably, at least one of the second contacts has a predetermined bending portion, and the network jack further has a terminal base assembled with the circuit board and having the acting portion.

Preferably, the terminal base has a frame opening containing the at lease one of the second contacts.

Preferably, an amount of the plural first contacting areas is 6.

Preferably, the plural first contacting areas include three pairs of contacting areas.

In accordance with a further respect of the present application, a method for manufacturing a network jack is provided. The method includes steps of: a) providing a circuit board having a first side, plural first contacting areas along the first side and plural second contacting areas, wherein the plural first contacting areas are between the plural second contacting areas and the first side, and plural distances between the first side and each of the plural second contacting areas are various, b) forming first contacts on the plural first contacting areas, c) forming second contacts on the plural second contacting areas, and d) bending the second contacts.

Preferably, the method further has a step of assembling a terminal base with the circuit board, and the terminal base and the first, and second contacting areas are on a same side of the circuit board.

Preferably, the terminal base has a contact frame and each of the second contacts would have a bending portion resulting from the contact frame after the terminal base is assembled with the circuit board.

Preferably, the method further has a step of bending the first contacts.

In accordance with a further respect of the present application, a network jack is provided. The network jack includes a circuit board, first contacts, second contacts and an acting portion. The circuit board has a first side, plural first contacting areas arranged along the first side and plural second contacting areas. The plural first contacting areas are between the plural second contacting areas and the first side, and plural distances between the first side and each of the plural second contacting areas are various. The first contacts are mounted on the first contacting areas, and the second contacts mounted on the second contacting areas. The acting portion bends each of the second contacts to make the second contacts have at least two arranged directions.

Preferably, at least one of the second contacts has a predetermined bending portion, and the network jack further comprises a terminal base assembled with the circuit board and having the acting portion.

Preferably, the terminal base has a frame opening containing the at lease one of the second contacts.

In accordance with a further respect of the present application, a method for manufacturing a network jack is provided. The method includes steps of: a) providing a circuit board having a first side, plural first contacting areas along the first side and plural second contacting areas, wherein the plural first contacting areas are between the plural second contacting areas and the first side, and plural distances between the first side and each of the plural second contacting areas are various, b) forming first contacts on the plural first contacting areas, c) forming second contacts on the plural second contacting areas, and d) bending each of the second contacts to make the second contacts have at least two arranged directions.

Preferably, the method further includes a step of assembling a terminal base with the circuit board, and the terminal base and the first, and second contacting areas are on a same side of the circuit board.

Preferably, the terminal base has a contact frame and each of the second contacts would have a bending portion resulting from the contact frame after the terminal base is assembled with the circuit board.

Preferably, the method further has a step of bending the first contacts.

The above contents and advantages of the present invention will become more readily apparent to those ordinarily skilled in the art after reviewing the following detailed descriptions and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 2:
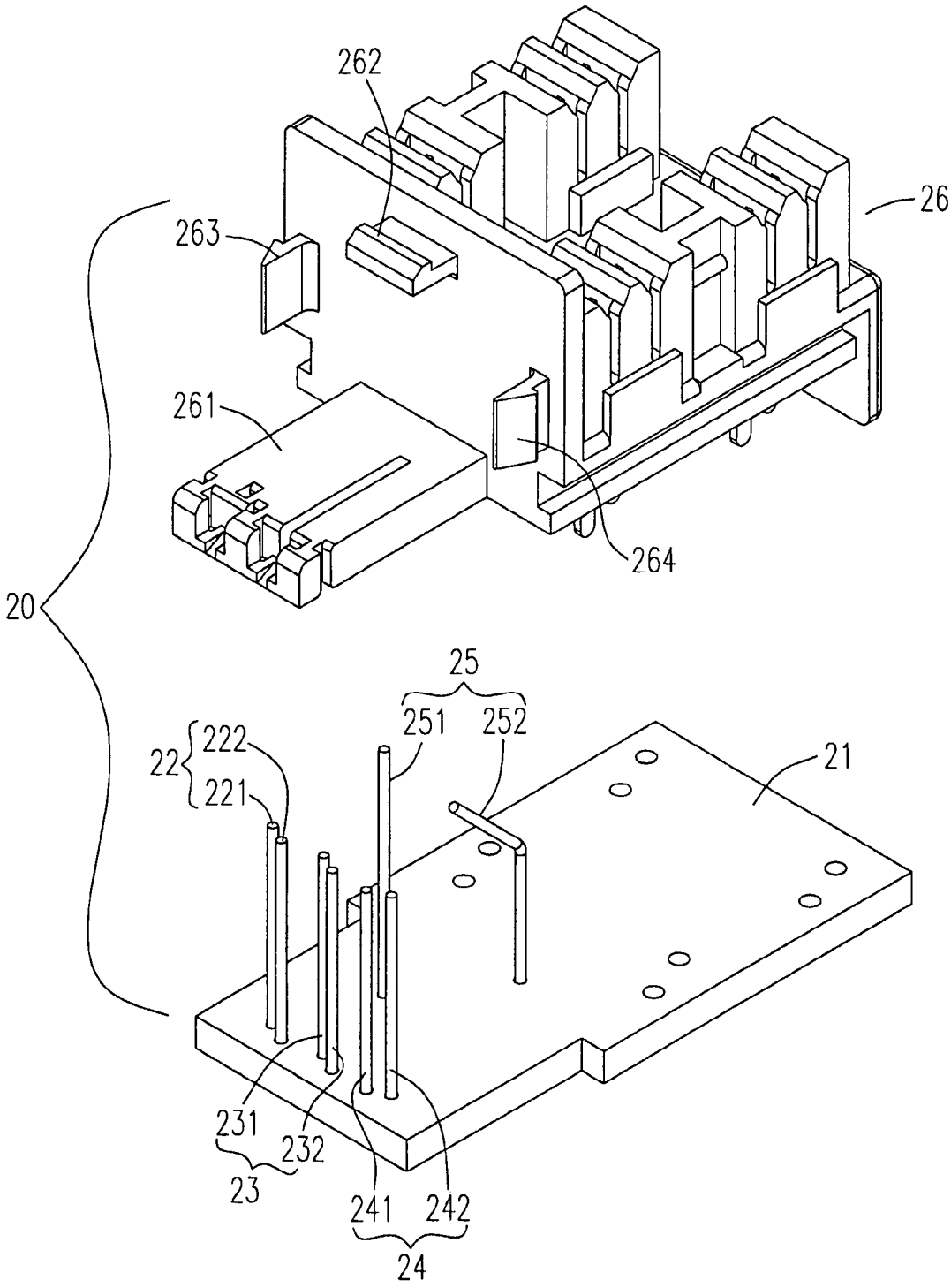
FIG. 2 shows a decomposition diagram of the network jack according to a preferred embodiment of the present invention.
Figure 3:
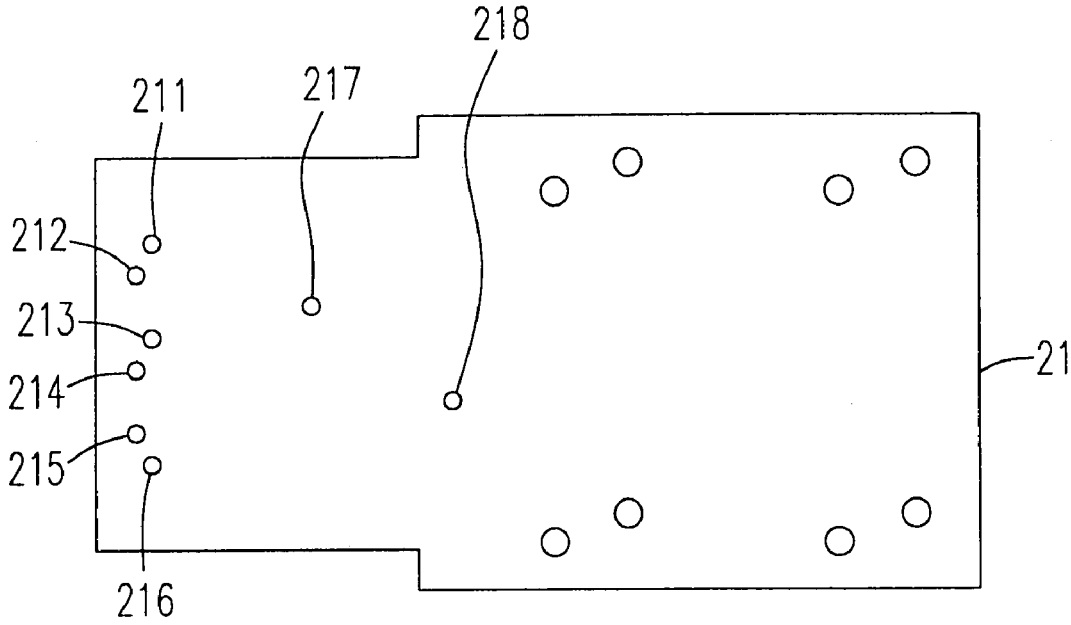
FIG. 3 shows the diagram of the printed circuit board shown in FIG. 2.

Please refer to FIGS. 2 and 3. FIG. 2 shows a decomposition diagram of the network jack according to a preferred embodiment of the present invention, and FIG. 3 shows the diagram of the printed circuit board shown in FIG. 2. The network jack 20 includes the printed circuit board 21, the first contact 221, the second contact 222, the third contact 231, the fourth contact 232, the fifth contact 241, the sixth contact 242, the seventh contact 251, the eighth contact 252, and the terminal base 26. The terminal base 26 includes the contact fame 261, the first protrusion 262, the second protrusion 263 and the third protrusion 264. The first and second contacts 221 and 222 form a first contact pair 22, the third contact 231 and the fourth contact 232 form a second contact pair 23, the fifth contact 241 and the sixth contact 242 form a third contact pair 24, and the seventh contact 251 and the eighth contact 252 form the fourth contact pair 25. As shown in FIG. 3, the printed circuit board 21 has the first location point 211, the second location point 212, the third location point 213, the fourth location point 214, the fifth location point 215, the sixth location point 216, the seventh location point 217 and the eighth location point 218. As shown in FIGS. 2 and 3, the first contact 221 is mounted on the first location point 211, the second contact 222 is mounted on the second location point 212, the third contact 231 is mounted on the third location point 213, the fourth contact 232 is mounted on the fourth location point 214, the fifth contact 241 is mounted on the fifth location point 215, the sixth contact 242 is mounted on the sixth location point 216, the seventh contact 251 is mounted on the seventh location point 217, and the eight contact 252 is mounted on the eight location point 218.

Please refer to FIG. 3, it is to be noted that the distance between the two contacts respectively mounted on the location points 217 and 218 in the present application would be greater than that of the prior art, U.S. Pat. No. 6,749,466. Accordingly, the network jack 20 of the present application could be operated with the relatively higher voltage, such as 1000 volts.

Please refer to FIGS. 2 and 3, during the manufacturing process of the network jack 20, the eighth contact 252 would be provided with a predetermined bending portion 2521 after mounted on the eighth location points 217 and 218.

Figure 4A:
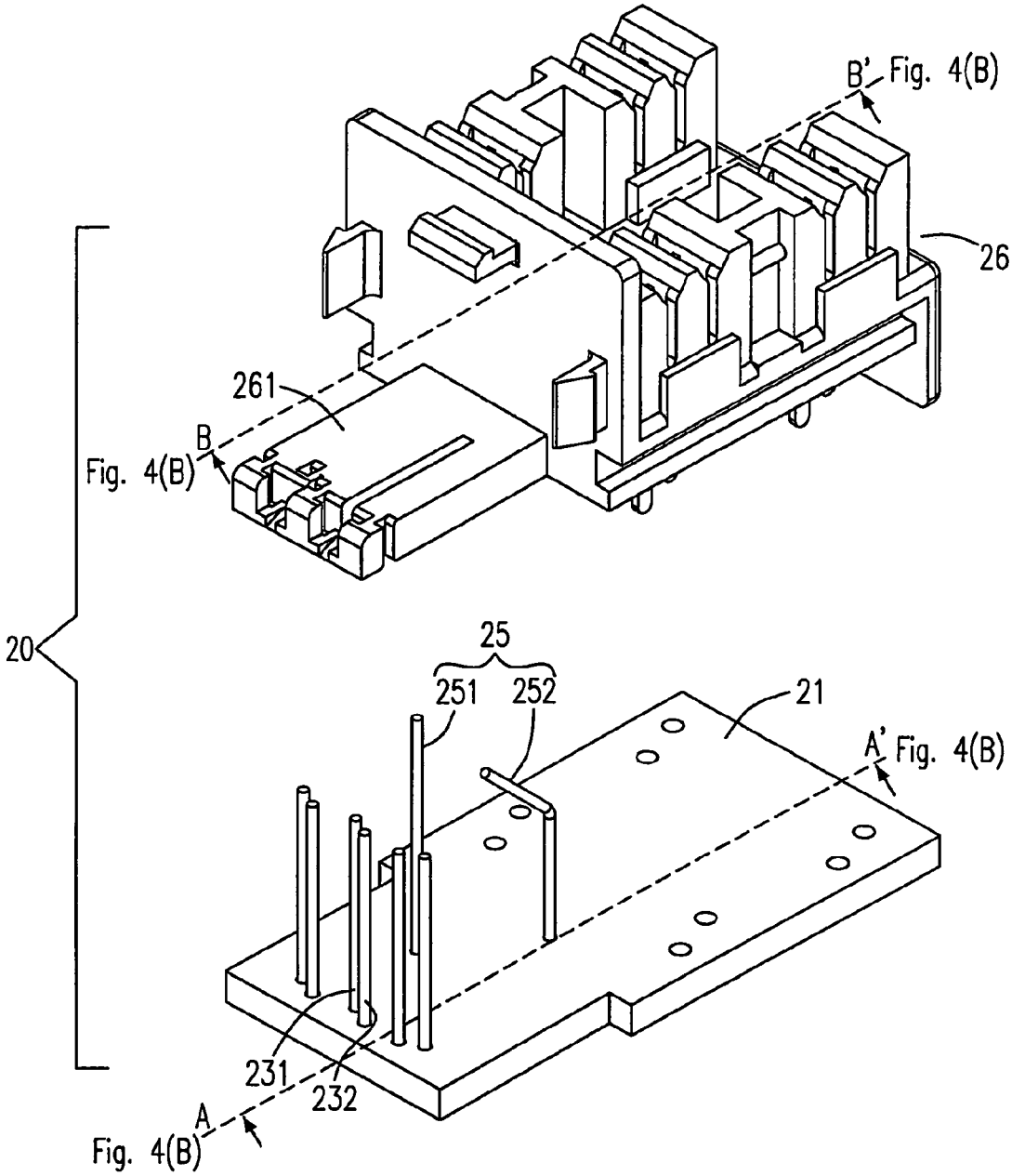
FIG. 4(A) is the diagram showing the printed circuit board and the terminal base of the present invention.
Figure 4B:
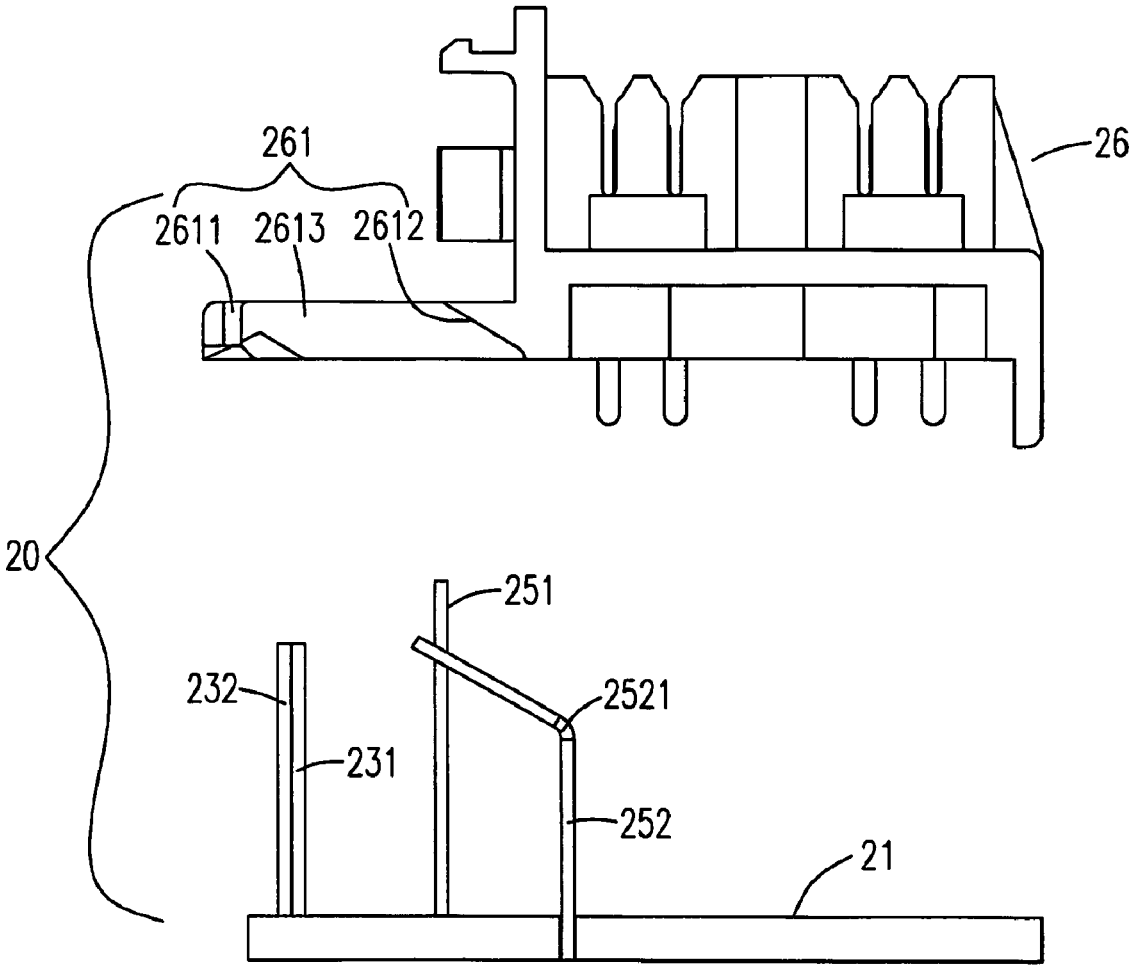
FIG. 4(B) is the diagram showing side views of the circuit board and the terminal base respectively taken along the broken lines A-A' and B-B' as shown in FIG. 4(A) according to a preferred embodiment of the present invention.
Figure 5A:
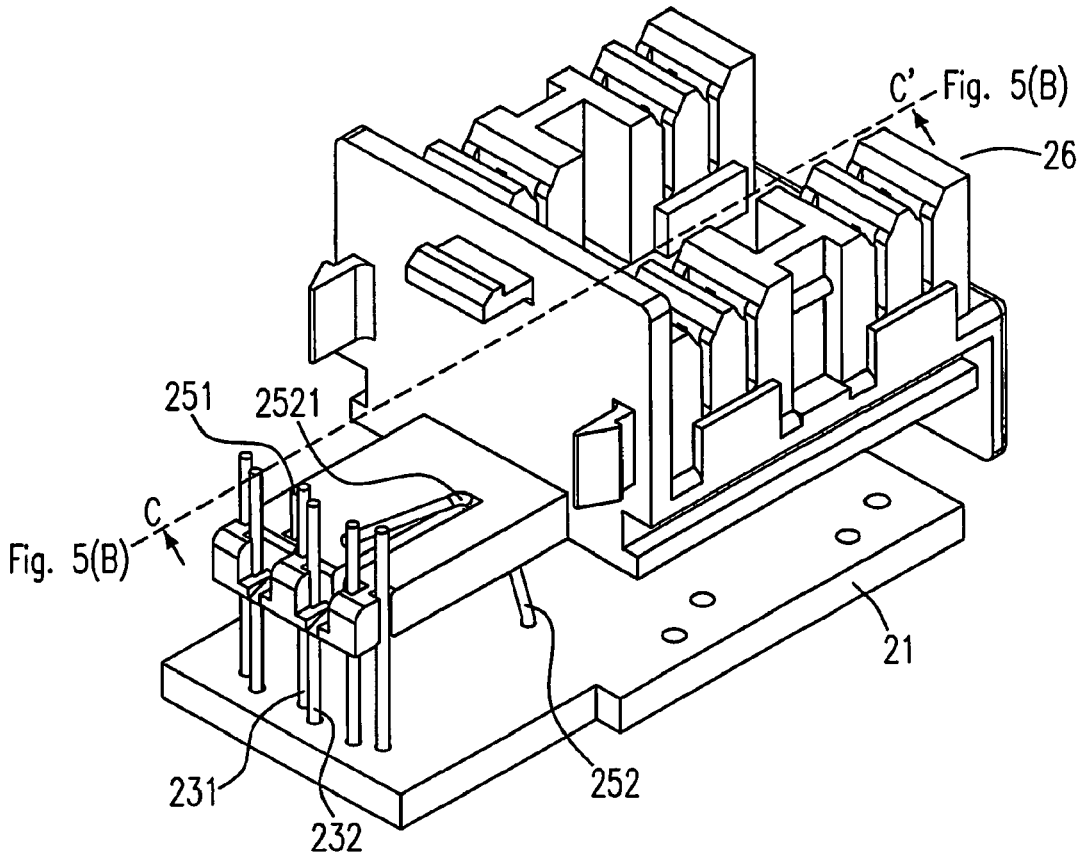
FIG. 5(A) is the diagram showing the printed circuit board partially assembled with the terminal base of the present invention.
Figure 5B:
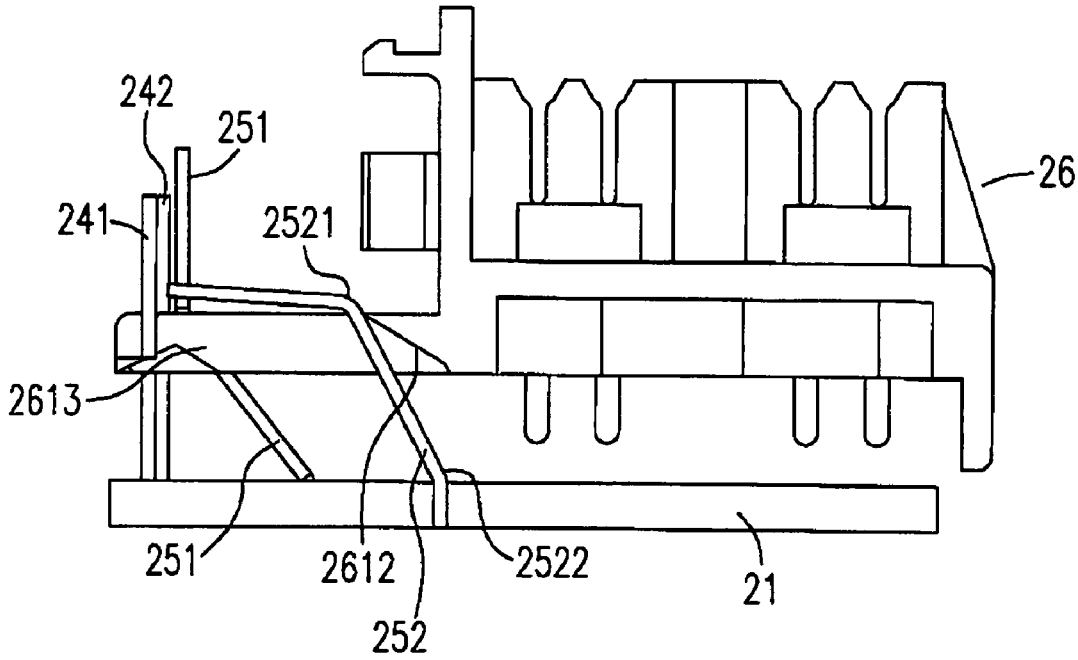
FIG. 5(B) is a diagram showing a sectional view of the circuit board partially assembled with the terminal base taken along the broken line C-C' as shown in FIG. 5(A) according to a preferred embodiment of the present invention.

Please refer to FIGS. 4(A), 4(B), 5(A) and 5(B). FIG. 4(A) is the diagram showing the printed circuit board 21 and the terminal base 26. FIG. 4(B) is the diagram showing the side views of the printed circuit board 21 and the terminal base 26, respectively taken along the broken lines A-A' and B-B' as shown in FIG. 4(A). FIG. 5(A) is the diagram showing the terminal base 26 partially combined with the printed circuit board 21. FIG. 5(B) is the diagram showing a sectional view of the circuit board partially assembled with the terminal base, taken along the broken line C-C' as shown in FIG. 5(A). As shown in FIG. 4(B), the contact frame 261 further has a frame bending portion 2612 and a tunnel 2613. The eighth contact 252 would be bent by the frame bending portion 2612 and have another bending portion 2522 (please refer to FIG. 5(B)) after the printed circuit board 21 is assembled with the terminal base 26 and the eighth contact 252 passes through the tunnel 2613. The assembling process of the printed circuit board 21 and the terminal base 26 could be found in FIGS. 4(B) and 5(B). As shown in FIG. 5(B), the eighth contact 252 would have two bending portions 2521 and 2522 after the terminal base 26 is assembled with the printed circuit board 21. The eighth contact 252 is bent by the frame bending portion 2612 and passes through the tunnel 2613.

Please refer to FIGS. 4 and 5, the contact frame 261 has plural contact openings 2611, and the first, second, third, fourth contacts (not shown therein), the fifth and sixth contacts 241 and 242 pass through the plural contact openings 2611.

Figure 6A:
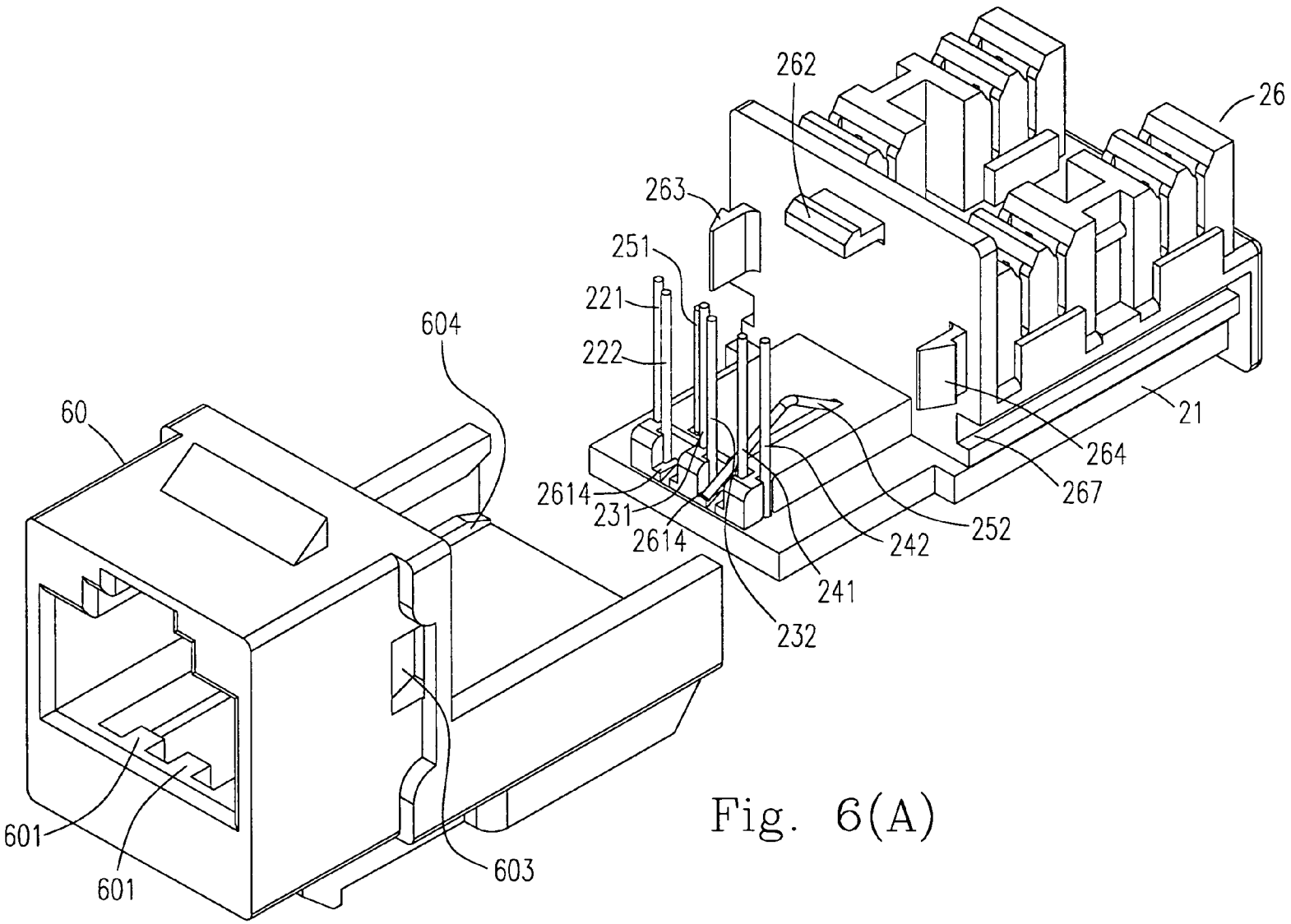
FIGS. 6(A) and 6(B) are diagrams showing the pre-assembly and post-assembly of a plug portion, the terminal base and the circuit board according to a preferred embodiment of the present invention.
Figure 6B:
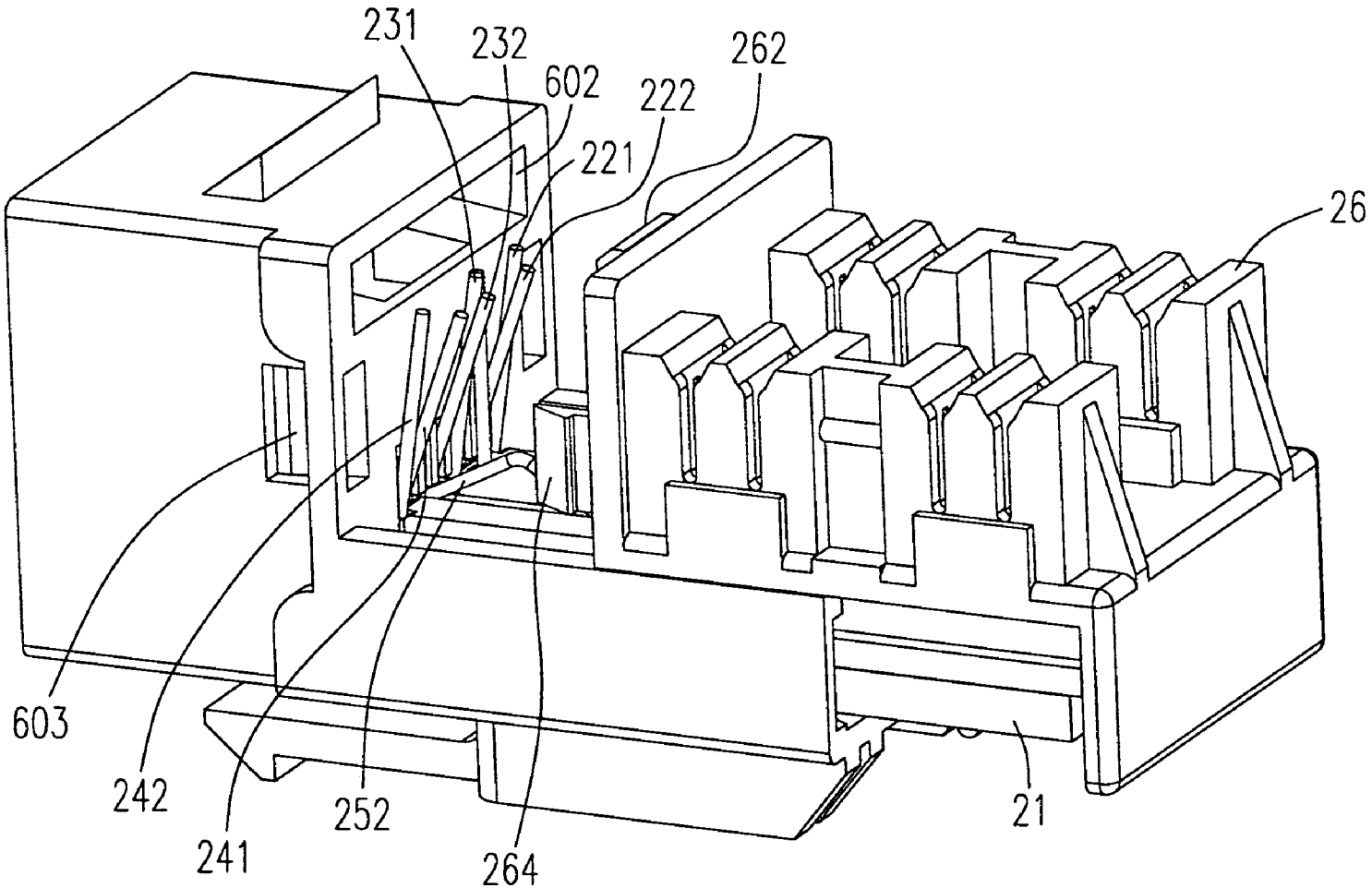

Please refer to FIGS. 6A and 6B, which are diagrams showing the assembling of a plug portion 60, the terminal base 26 and the printed circuit board 21. As shown in FIGS. 6A and 6B, the plug portion 60 includes the frame buckle 601 detachably assembled with the frame connecting portion 2614, the first connecting portion 602 to be detachably connected with the first protrusion 262, the second connecting portion 603 to be detachably connected with the third protrusion 264. The terminal base, 26 has a channel 267 for containing the protrusion 604. The plug portion 60 could be assembled with the terminal base 26 via the protrusion 604 moving along the channel 267. During the assembling of the plug portion 60, the terminal base 26 and the printed circuit board 21, the first, second, third, fourth, fifth and sixth contacts 221, 222, 231, 232, 241 and 242 would be bent by the plug portion 60 (please refer to FIG. 6B). Therefore, during the manufacturing process of the present network jack 20, no specific bending machine is necessary to make the first to sixth contacts 221 to 242 bend. Accordingly, the relevant bending cost in the prior art could be saved in the present application.

Figure 7A:
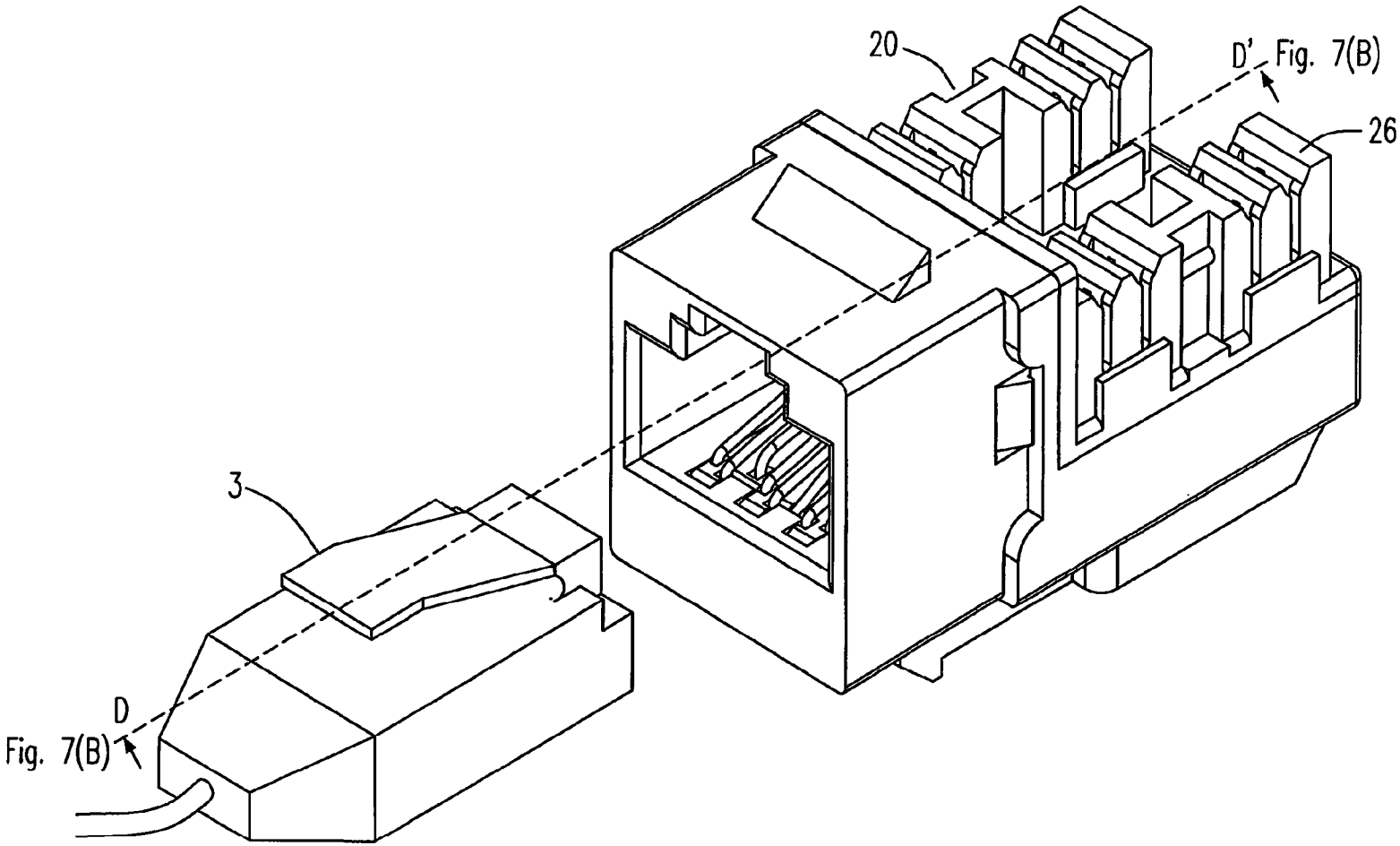
FIG. 7(A) is a diagram showing the assembled network jack 20 and the internet plug 3.
Figure 7B:
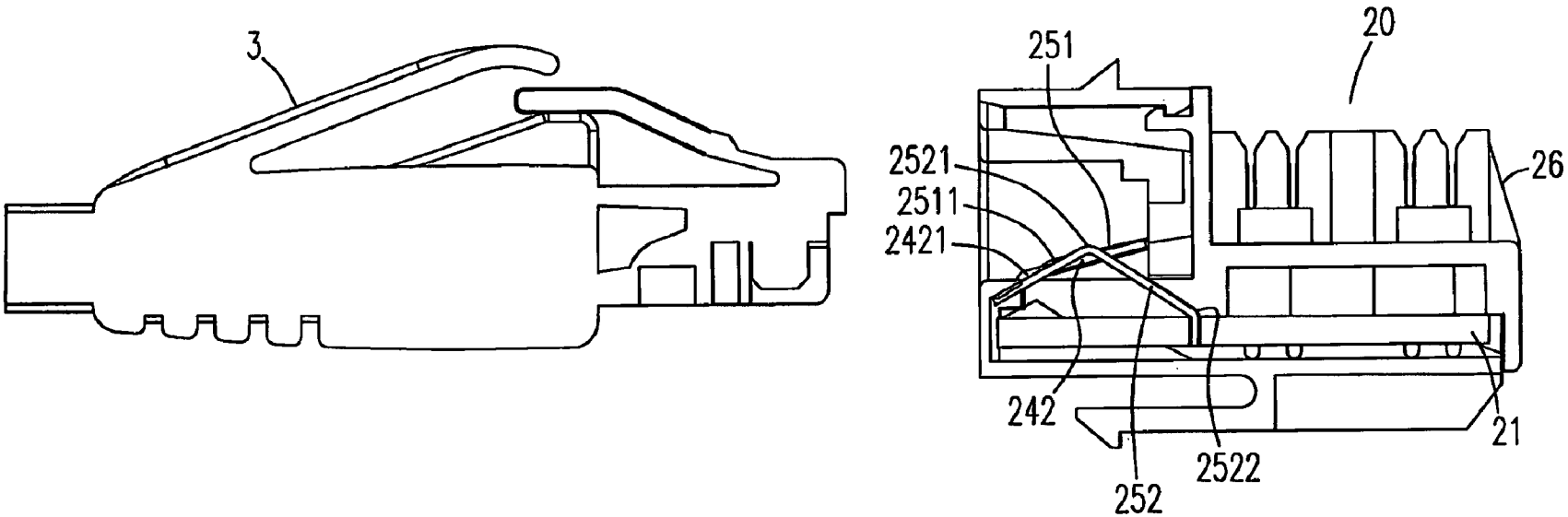
FIG. 7(B) is a diagram showing a sectional view of the assembling of the network jack and an internet plug taken along the broken line D-D' as shown in FIG. 7(A) according to preferred embodiment of the present application.
Figure 8:
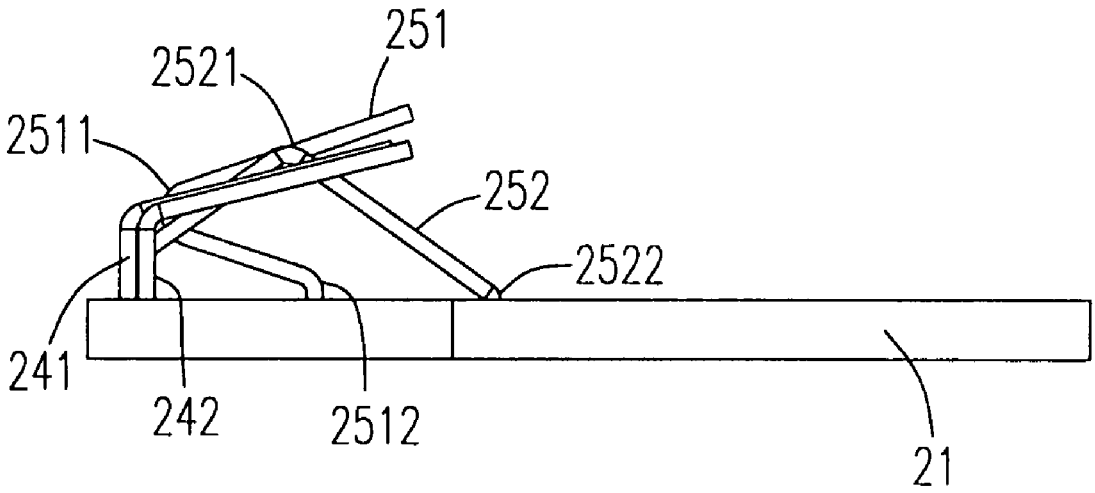
FIG. 8 is a diagram showing the relevant mounting relationship among the sixth contact, the seventh contact and the eighth contact according to a preferred embodiment of the present invention.

Please refer to FIGS. 7(A) and 7(B). FIG. 7(A) is a diagram showing the assembled network jack 20 and the internet plug 3. FIG. 7(B) is a diagram showing a sectional view of the assembled network jack 20 and the internet plug 3, taken along the broken line D-D' as shown in FIG. 7(A). As shown in FIG. 7(B), after the terminal base 26 is assembled with the printed circuit board 21, the eighth contact 252 would have two bending portions 2521 and 2522, the sixth contact 252 would have only one bending portion 2421, and the seventh contact 251 would have bending portions 2511 and 2512, as shown in FIG. 8, which is a diagram showing the relevant mounting relationship among the sixth contact 242, the seventh contact 251 and the eighth contact 252.

Figure 1:
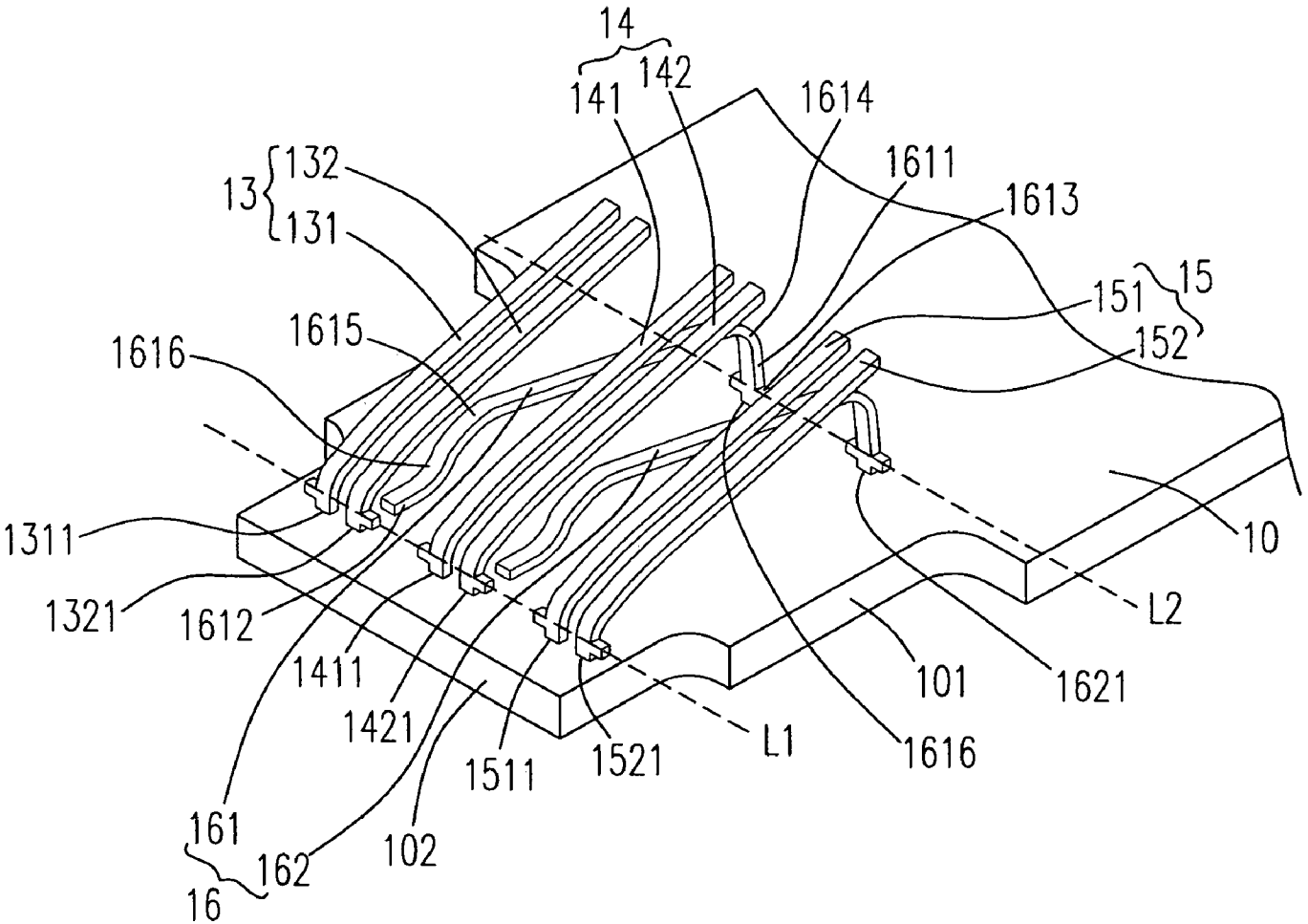
Fig. 1 (PRIOR ART)
FIG. 1 shows a diagram of the circuit board in the prior art.

Please refer to FIGS. 1, 5 and 7, in the prior art, U.S. Pat. No. 6,749,466, there is no supporting structure for the contacts 131, 132, 141, 142, 151, 152, 161 and 162, so that the relevant durabilities are not so good when connected with an internet plug. Nevertheless, in the present application, the contact frame 261 could provide the support to the contacts 231, 232, 241, 242, 251, 252; 261 and 262, so that the life-spans of the contacts in the present application are greater than those in the prior art, U.S. Pat. No. 6,749,466.

In the present application, the contacts 221, 222, 231, 232, 241, 242, 251 and 252 are circular, so that their durabilities would be better than the conventional rectangular contacts, the contacts could provide the transmission with less crosstalk noise and the contacts could have nice telecommunication properties. In addition, it is to be noted that no push foot is necessary for the contact in the present application, so that the manufacturing process would become simple and the cost could be saved. The first, second, third and fourth contacts 221, 222, 231 and 242 of the present application are made of phosphor bronze with 3.5%-10% stannum and 0.01%-1% phosphor by weight. The phosphor bronze is easily molded and there is 50 micro-inch aurum coated thereon. Since the circular contact has a better flexibility than that of the rectangular contact, which is the shape of the contact in U.S. Pat. No. 6,749,466, the contact of the present could be made by phosphor bronze instead of the expensive beryllium copper and then have the desired stress response. Since the cost of the phosphor bronze is less than that of the beryllium copper, the producing cost of the present network jack is less than that of the prior art.

Figure 9:
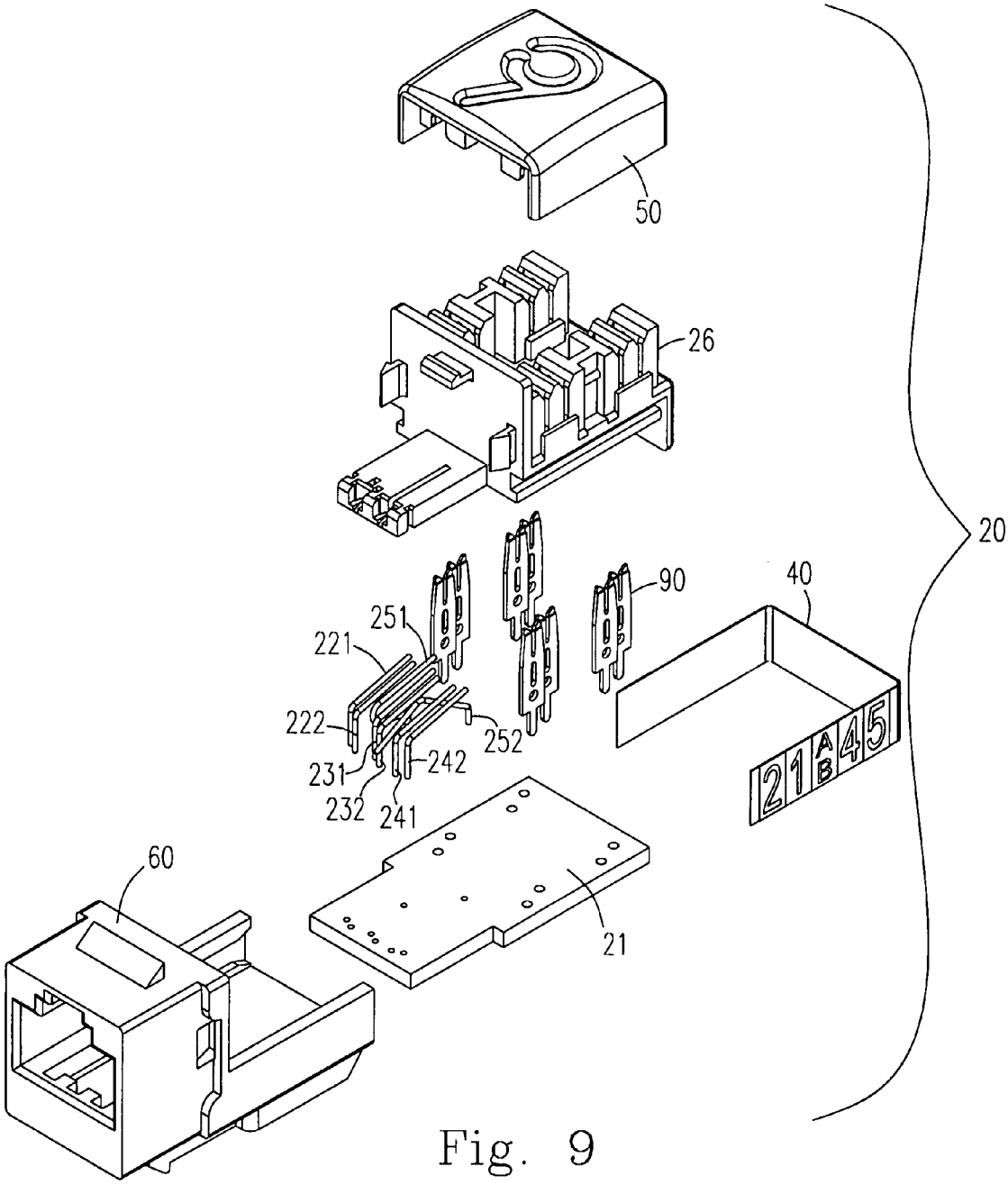
FIG. 9 is the explosive diagram of the network jack according to an embodiment of the present application.
Figure 10:
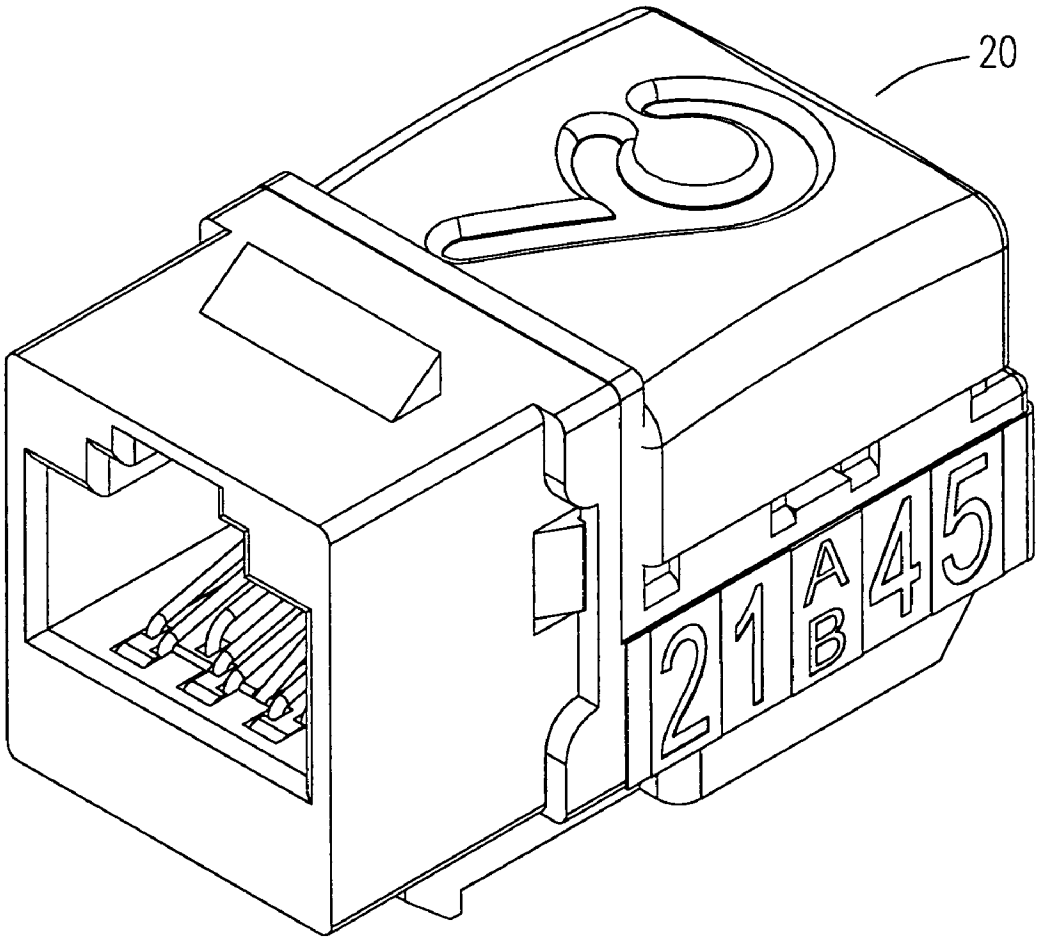
FIG. 10 is the appearance of the network jack according to the embodiment of the present application.

Please refer to FIGS. 9 and 10, which are the explosive diagram of the network jack according to an embodiment of the present application and the appearance of the network jack according to an the embodiment of the present application. As shown in FIG. 9, the network jack 20 includes the printed circuit board 21, the contacts 221, 222, 231, 232, 241, 242, 251 and 252, the chips 90, the terminal base 26, the plug portion 60, the cover 50 and the wiring map 40.

In order to further illustrate the changes of the seventh contact 251 and the eighth contact 252 during assembling, the different side views of the network jack are provided.

Figure 11:
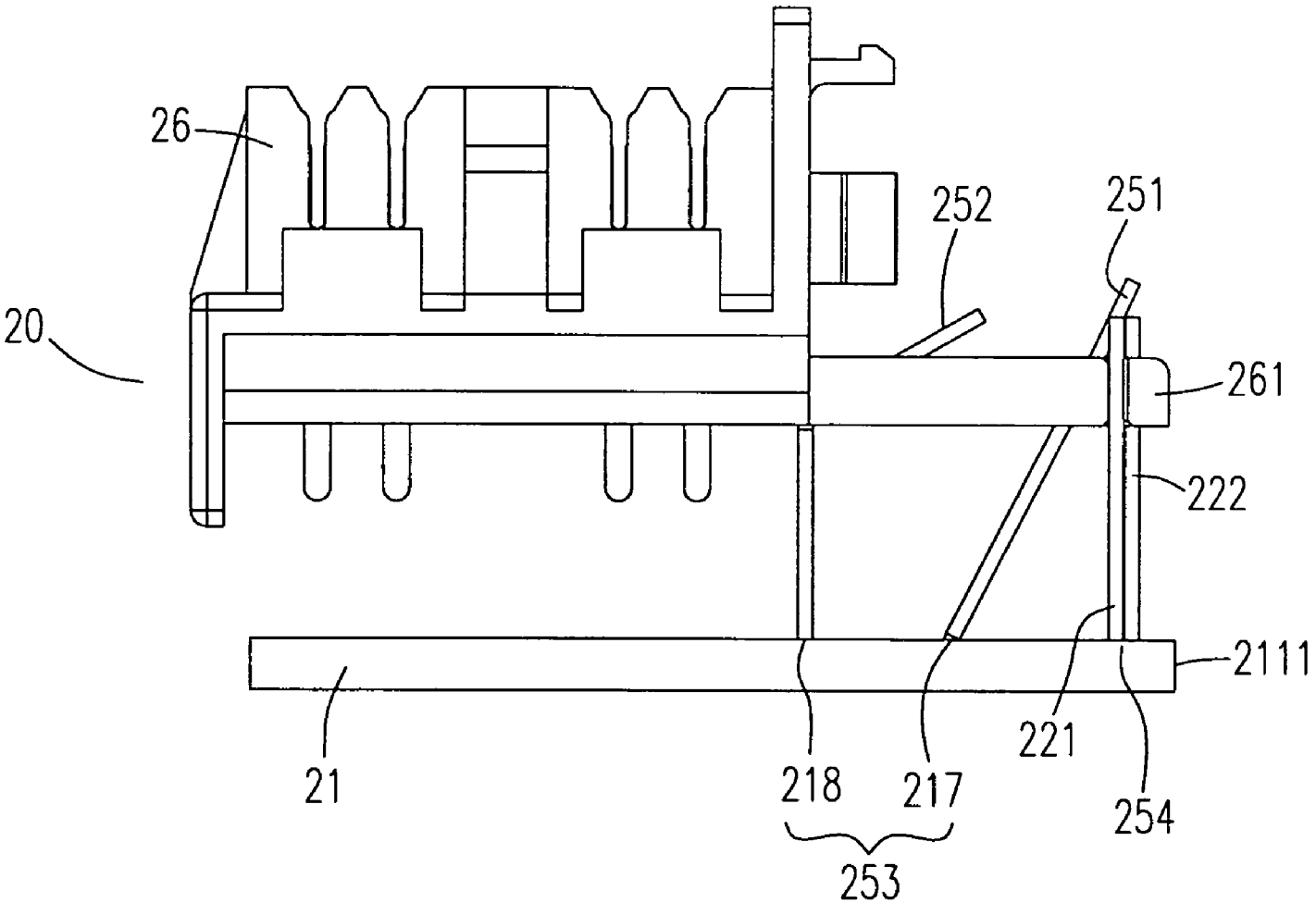
FIGS. 11 and 12 are the diagrams showing the assembling process of the circuit board and the terminal base according to a further preferred embodiment of the present invention.
Figure 12:
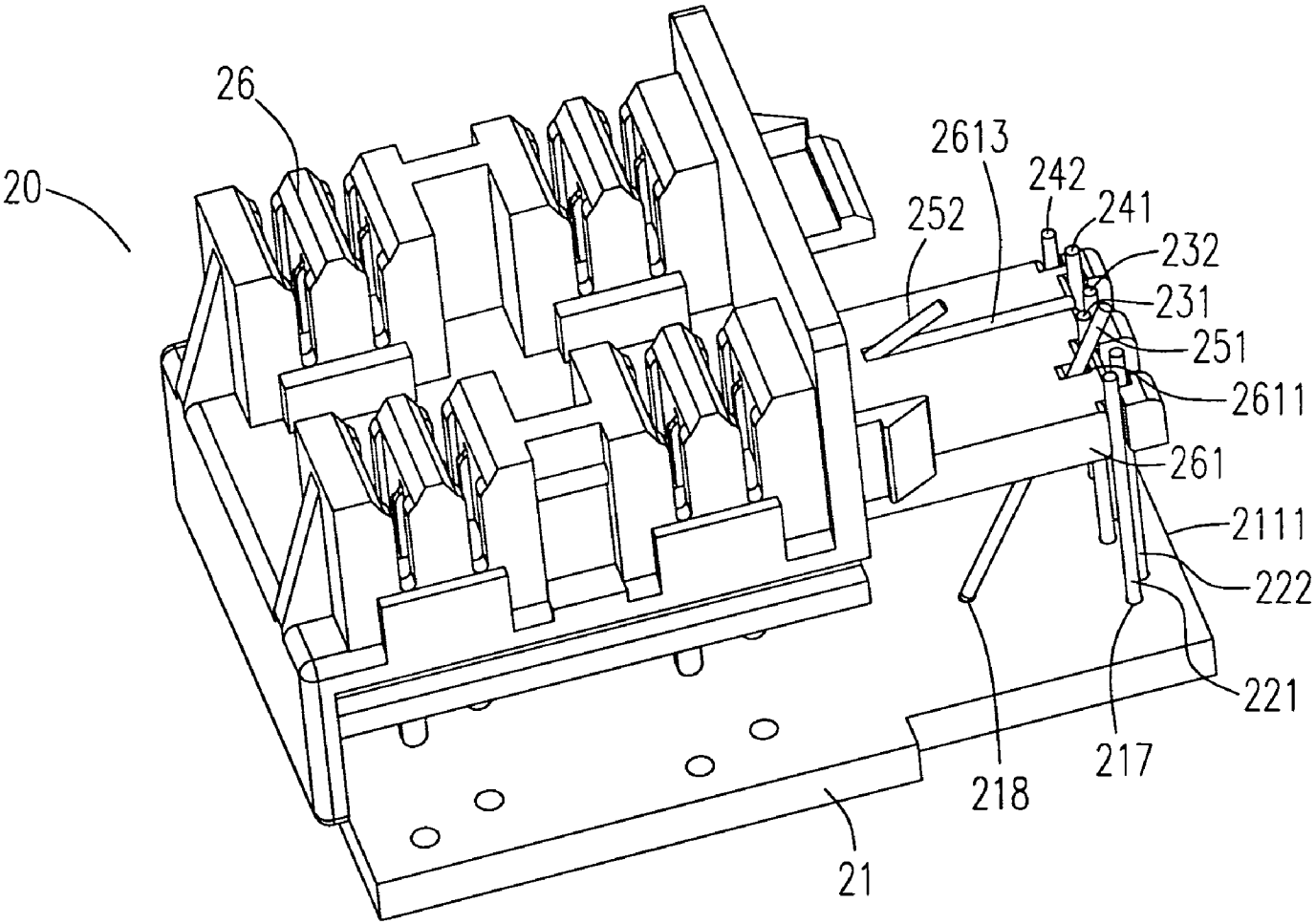

Please refer to FIGS. 11 and 12, which are the diagram showing the assembling process of the circuit board and the terminal base according to a preferred embodiment of the present invention. The network jack 20 includes the printed circuit board 21 and the terminal base 26 having a contact fame 261. The contact fame 261 has a through 2613 and an opening 2611. The printed circuit board 21 has two groups of contacting areas 254 and 253. The first group of contacting areas 254 includes three pairs of location points, the first to sixth location points 211-216 shown FIG. 3, arranged along the side 2111 of the printed circuit board 21. The second group of contacting areas 253 includes the seventh location point 217 and the eighth location point 218. The distance between the seventh location point 217 and the side 2111 of the printed circuit board 21 is different from that between eighth location point 218 and the side 2111 of the printed circuit board 21.

Figure 13A:
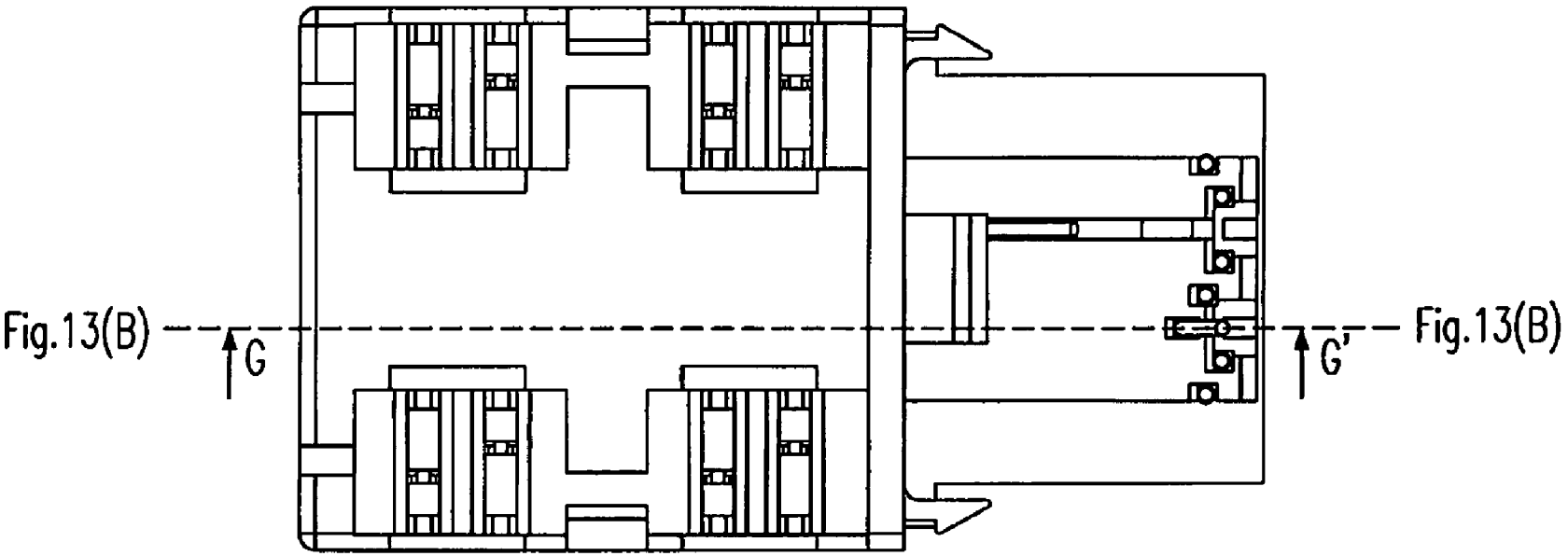
FIG. 13(A) is a top view of the network jack shown in FIG. 11 during the assembling process according to the preferred embodiment of the present invention.

Please refer to FIG. 13(A), which is a top view of the network jack shown in FIG. 11 during the assembling process according to the preferred embodiment of the present invention.

Figure 13B:
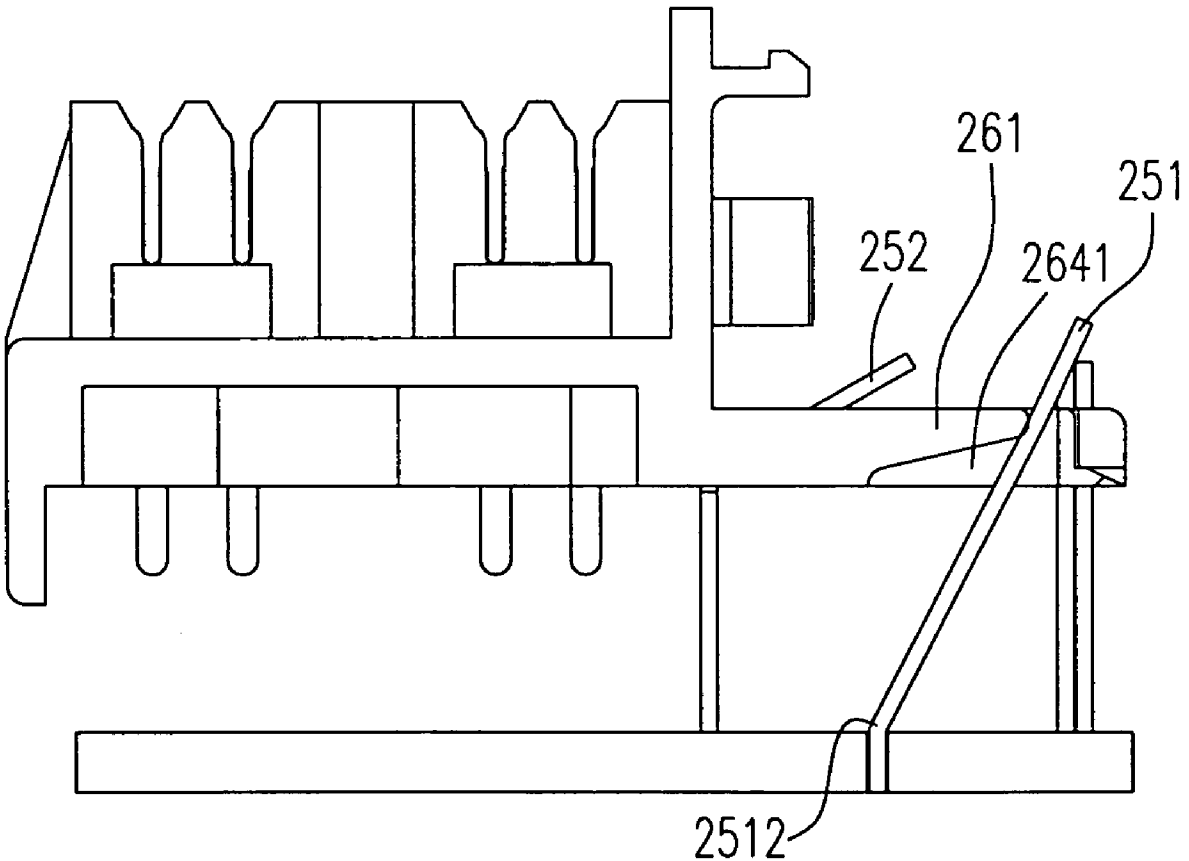
FIG. 13(B) is a sectional drawing of the network jack along the G-G' line shown in FIG. 13(A)

Please refer to FIG. 13(B), which is a sectional drawing of the network jack along the G-G' line shown in FIG. 13(A). As shown in FIG. 13, the seventh contact 251 passes through the opening 2641, and has a bending 2512.

After further assembling the printed circuit board 21 with the terminal base 26, the shapes of the seventh and eighth contacts 251 and 252 are further changed.

Figure 14A:
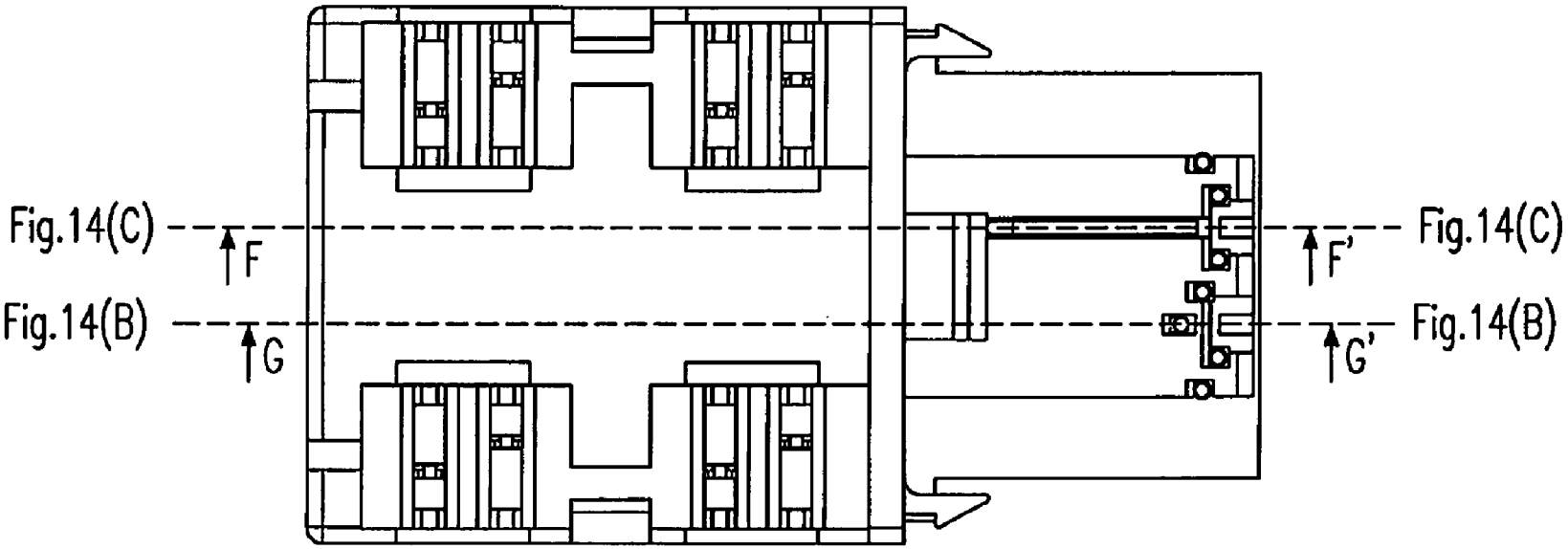
FIG. 14(A) is a top view of the network jack after a further assembling according to the preferred embodiment of the present invention.

Please refer to FIG. 14(A), which is a top view of the network jack after a further assembling according to the preferred embodiment of the present invention.

Figure 14B:
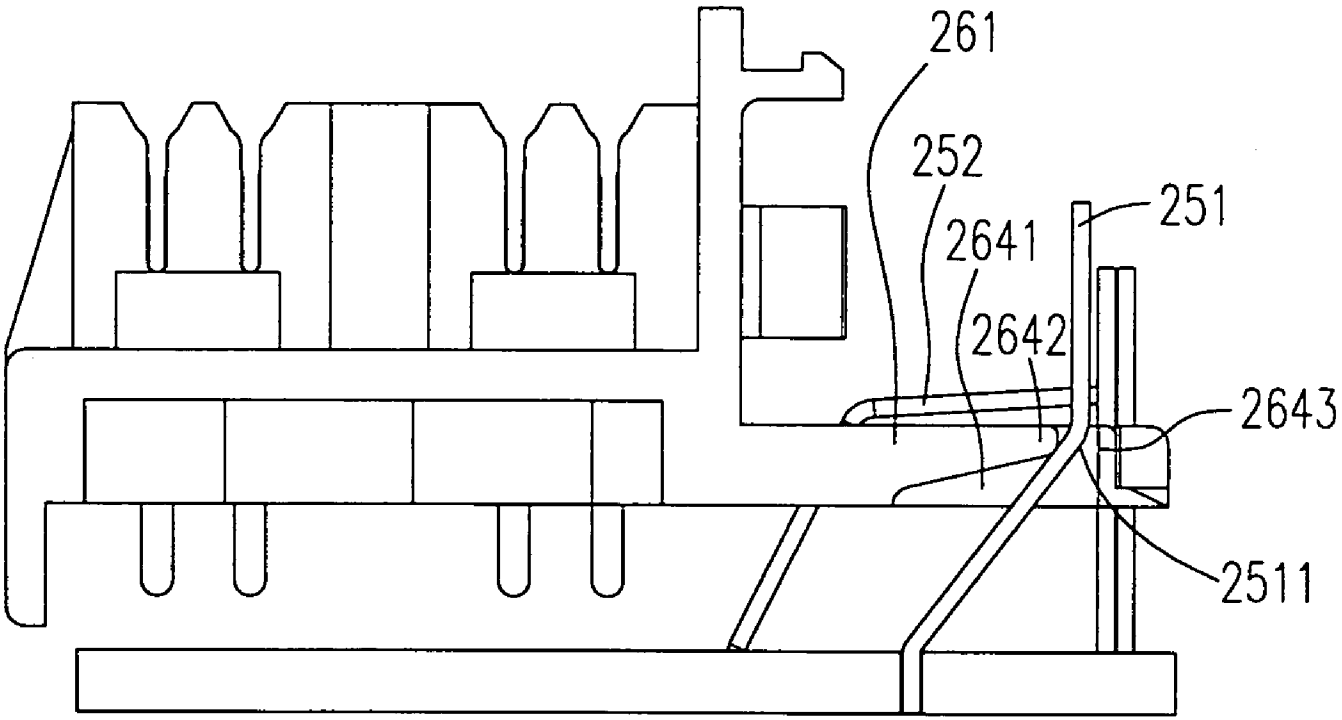
FIG. 14(B) is a sectional drawing of the network jack along the G-G' line shown in FIG. 14(A)

Please refer to FIG. 14(B), which is a cross-sectional diagram of the network jack along the H-H' line shown in FIG. 14(A). As shown in FIG. 14(B), the contact frame 26 includes a protrusion 2642 and a stop surface 2643. During the assembling process, the contact 251 would pass through the opening 2641 and form the bending portion 2511 by the protrusion 2642 and the stop surface 2643.

Figure 14C:
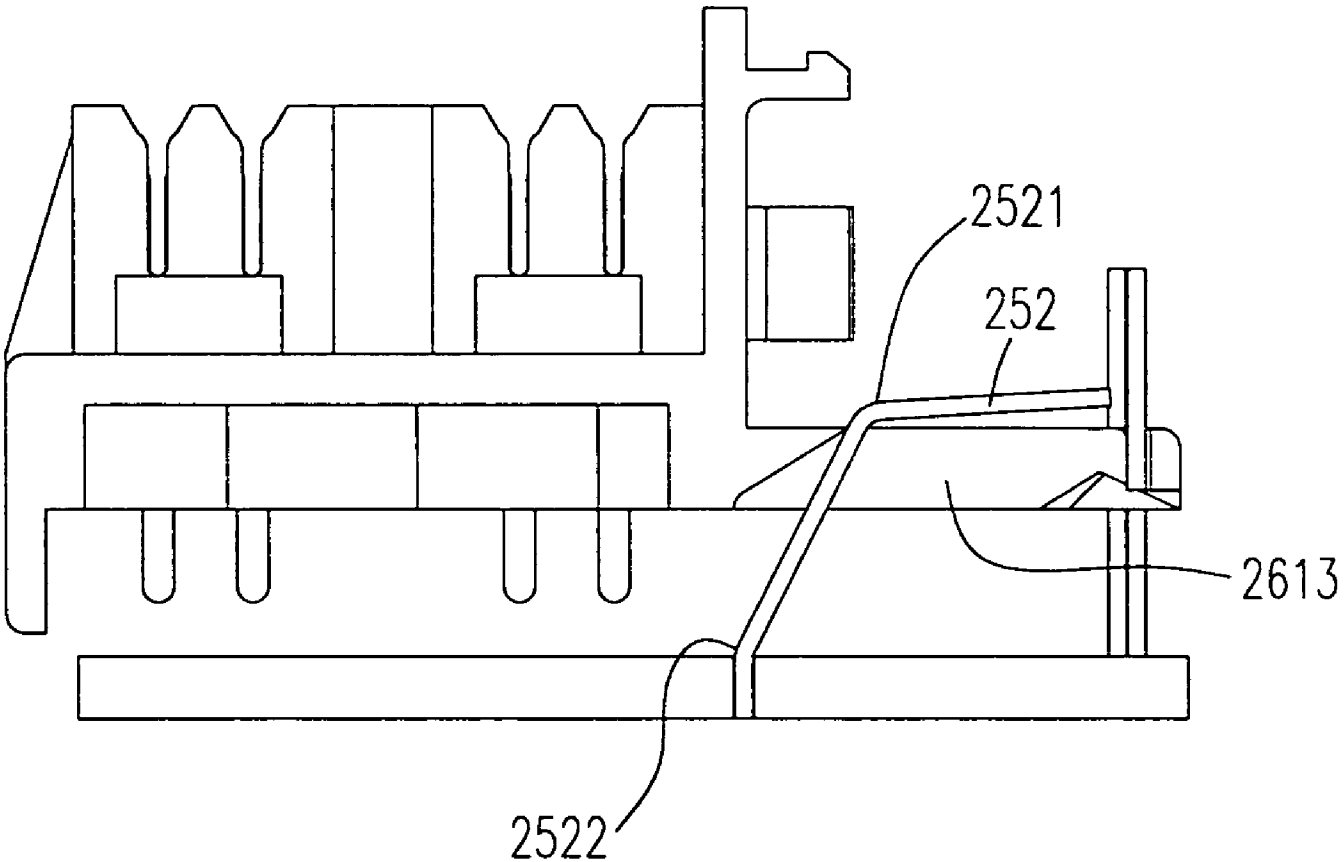
FIG. 14(C) is a sectional drawing of the network jack along the F-F' line shown in FIG. 14(A)
Figure 15:
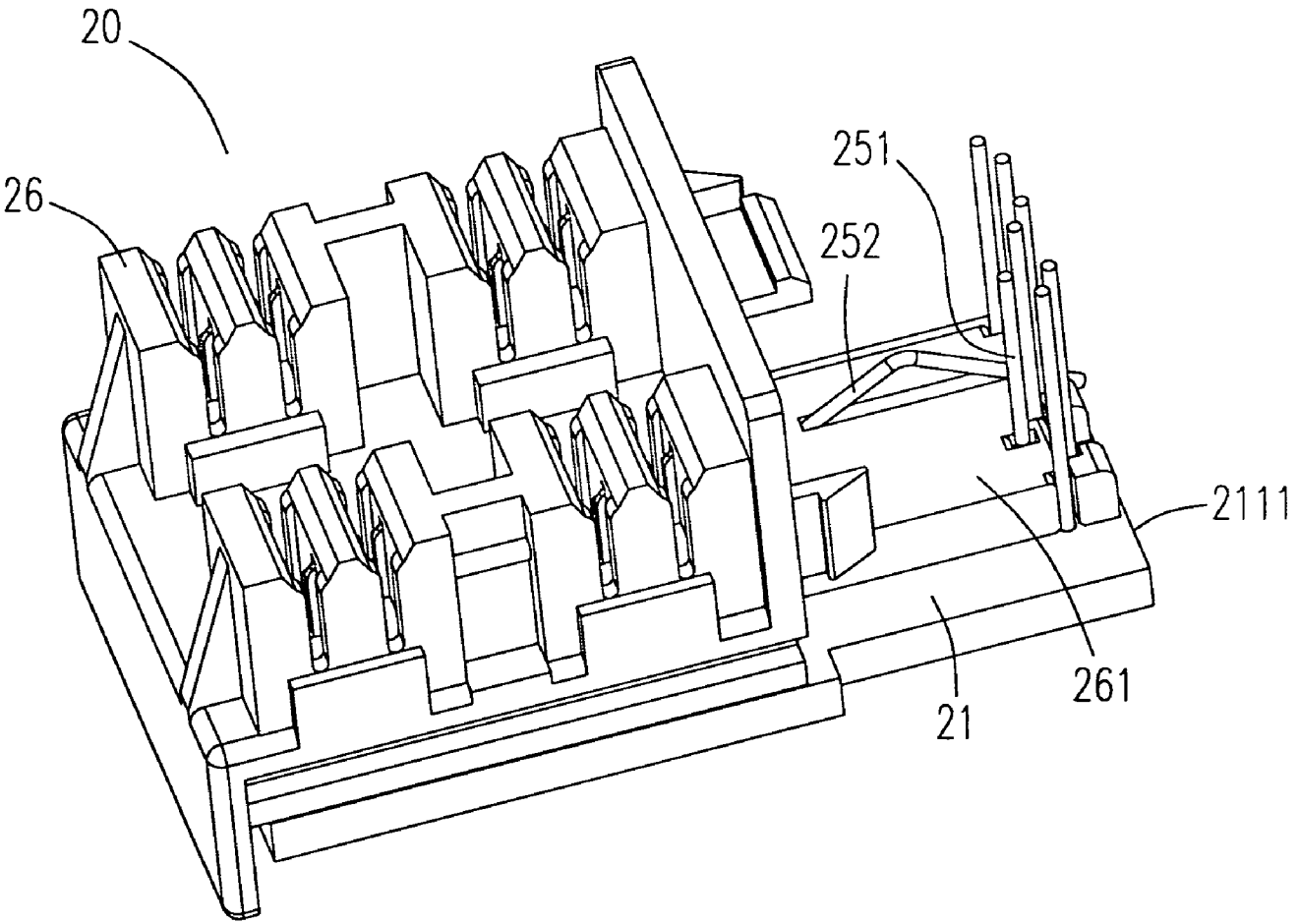
FIG. 15 is the diagram showing a network jack according to the preferred embodiment of the present invention.

Please refer to FIG. 14(C), which is a cross-sectional diagram of the network jack along the F-F' line shown in FIG. 14(A). As shown in FIG. 14(C), the contact frame 261 includes the tunnel 2613 containing the eighth contact 252. After assembling the terminal base 26 and the printed circuit board 21, the eighth contact 252 would have the bending portions 2521 and 2522 by the contact frame 261. In addition, FIG. 15 shows the diagram of the network jack 20 after the terminal base 26 is assembled to the printed circuit board 21. As shown in FIG. 15, the seventh and eighth contacts 251 and 252 would have different directions and have different distances from the side 2111 of the printed circuit board 21.

In view of aforesaid discussions, the present invention provides a network jack having a circuit board with a contact pair parallel to another contact pair, a terminal base able to bend contacts during the assembling of the terminal base and the circuit board, and a contact frame able to bend the contacts during the assembling of the plug portion and the terminal base. In addition, the present invention also provides a network jack having two groups of contacts, where the first group contacts are arranged along a side of the network jack and the respective distances between each of the second group contacts and the side of the network jack are various. Since the present network jack and the relevant manufacturing method are able to overcome the drawbacks of the conventional network jack, such as the narrow operating voltage range, the high cost, the complex manufacturing process and the delicate assembling required, the present invention is extremely suitable for being used in the industrial production.

While the invention has been described in terms of what is presently considered to be the most practical and preferred embodiment, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A network jack, comprising:

a circuit board having a first side, plural first contacting areas arranged along the first side and plural second contacting areas, wherein the plural first contacting areas are between the plural second contacting areas and the first side, and plural distances between the first side and each of the plural second contacting areas are various;

first bendable contacts respectively inserted into the first contacting areas;

second bendable contacts respectively inserted into the second contacting areas; and an acting portion directly bending the second bendable contacts to make the second bendable contacts have respective directions different from each other, wherein the first bendable contacts and the second bendable contacts contact with an external plug.

2. A network jack according to claim 1, wherein an amount of the plural first contacting areas is 6.

3. A network jack according to claim 1, wherein the plural first contacting areas include three pairs of contacting areas.

4. A network jack according to claim 1, wherein the first and the second bendable contacts are cylindrical contacts.

5. A network jack according to claim 1, wherein at least one of the second bendable contacts has a predetermined bending portion, and the network jack further comprises a terminal base assembled with the circuit board and having the acting portion.

6. A network jack according to claim 5, wherein the terminal base comprises a frame opening containing the at least one of the second bendable contacts.

7. A method for manufacturing a network jack, comprising steps of:

a) providing a circuit board having a first side, plural first contacting areas along the first side and plural second contacting areas, wherein the plural first contacting areas are between the plural second contacting areas and the first side, and plural distances between the first side and each of the plural second contacting areas are various;

b) forming first bendable contacts on the plural first contacting areas;

c) forming second bendable contacts on the plural second contacting areas; and d) bending the second bendable contacts by an acting portion assembled to the circuit board to make the second bendable contacts have respective directions different from each other for forming the network jack, wherein the first bendable contacts and the second bendable contacts contact with an external plug.

8. A method according to claim 7, further comprising a step of assembling a terminal base with the circuit board, and the terminal base and the first, and second contacting areas are on a same side of the circuit board.

9. A method according to claim 8, wherein the terminal base comprises a contact frame and each of the second bendable contacts would have a bending portion resulting from the contact frame after the terminal base is assembled with the circuit board.

10. A method according to claim 9, further comprising a step of bending the first bendable contacts.

11. A network jack, comprising:

a circuit board having a first side, plural first contacting areas arranged along the first side and plural second contacting areas, wherein the plural first contacting areas are between the plural second contacting areas and the first side, and plural distances between the first side and each of the plural second contacting areas are various;

first bendable contacts inserted into the first contacting areas;

second bendable contacts inserted into the second contacting areas; and an acting portion directly bending each of the second bendable contacts to make the second bendable contacts have at least two arranged directions;

wherein the first bendable contacts and the second bendable contacts contact with an external plug.

12. A network jack according to claim 11, wherein at least one of the second contacts has a predetermined bending portion, and the network jack further comprises a terminal base assembled with the circuit board and having the acting portion.

13. A network jack according to claim 12, wherein the terminal base comprises a frame opening containing the at least one of the second contacts.

14. A method for manufacturing a network jack, comprising steps of:

a) providing a circuit board having a first side, plural first contacting areas along the first side and plural second contacting areas, wherein the plural first contacting areas are between the plural second contacting areas and the first side, and plural distances between the first side and each of the plural second contacting areas are various;

b) forming first bendable contacts on the plural first contacting areas;

c) forming second bendable contacts on the plural second contacting areas; and d) bending each of the second bendable contacts by assembling an acting portion on the circuit board to make the second bendable contacts have at least two arranged directions; wherein the first bendable contacts and the second bendable contacts contact with an external plug.

15. A method according to claim 14, further comprising a step of assembling a terminal base with the circuit board, and the terminal base and the first, and second contacting areas are on a same side of the circuit board.

16. A method according to claim 15, wherein the terminal base comprises a contact frame and each of the second contacts would have a bending portion resulting from the contact frame after the terminal base is assembled with the circuit board.

17. A method according to claim 14, further comprising a step of bending the first contacts.

* * * * *